US011117711B2

(12) United States Patent
Zanon et al.

(10) Patent No.: US 11,117,711 B2
(45) Date of Patent: Sep. 14, 2021

(54) BAG MADE OF PAPER MATERIAL FOR ARCHIVING ARTICLES AND METHOD FOR ARCHIVING AN ARTICLE IN SAID BAG

(71) Applicants: Walter Zanon, Campodarsego (IT); Stefano Giacometti, Vigonza (IT)

(72) Inventors: Walter Zanon, Campodarsego (IT); Stefano Giacometti, Vigonza (IT)

(73) Assignee: J.B. MACHINES S.R.L., Vigonza (IT)

( * ) Notice: Subject to any disclaimer, the term of this patent is extended or adjusted under 35 U.S.C. 154(b) by 0 days.

(21) Appl. No.: 16/699,778

(22) Filed: Dec. 2, 2019

(65) Prior Publication Data

US 2021/0086949 A1 Mar. 25, 2021

(30) Foreign Application Priority Data

Sep. 20, 2019 (IT) ..... 102019000016883

(51) Int. Cl.
*B65D 33/18* (2006.01)
*B65D 30/00* (2006.01)

(52) U.S. Cl.
CPC ..... *B65D 33/18* (2013.01); *B65D 31/00* (2013.01)

(58) Field of Classification Search
CPC ..... B65D 33/18; B65D 31/00; B65D 27/06; B65D 27/14; B65D 27/38
USPC ..... 383/203, 204, 205; 229/301, 304, 305, 229/310, 311
See application file for complete search history.

(56) References Cited

U.S. PATENT DOCUMENTS 3,874,582 A * 4/1975 Wang ..... B65D 27/06 229/303
3,982,689 A * 9/1976 Retrum ..... B65D 27/04 229/71
4,781,296 A * 11/1988 Morris ..... B26D 3/085 229/309
4,819,807 A 4/1989 Giger
5,875,964 A * 3/1999 Pham ..... B65D 27/06 229/303
5,893,514 A * 4/1999 Fletcher ..... B65D 27/34 229/309

(Continued)

FOREIGN PATENT DOCUMENTS

DE 202015103839 U1 7/2015
GB 2323350 A 9/1998

(Continued)

*Primary Examiner* — Jes F Pascua
(74) *Attorney, Agent, or Firm* — Mark M. Friedman

(57) ABSTRACT

Bag made of paper material for archiving articles comprising a first and a second sheet-like element and a closure flap projectingly extended from the first sheet-like element and susceptible of being folded in partial superimposition on the second sheet-like element in order to close the bag.
The closure flap is provided with a first portion for a first closure of the bag and with a second portion for a second closure of the bag, and between such first and second portion a tear tape is arranged which is susceptible of being torn in order to separate the first portion from the second portion.
In addition, the bag is provided with a removable flap projectingly extended from the second sheet-like element between a second free end and a weakening line, which is susceptible of being torn in order to remove the removable flap from the second sheet-like element.

10 Claims, 5 Drawing Sheets

(56) References Cited

U.S. PATENT DOCUMENTS

| | | | | | |
|---|---|---|---|---|---|
| 6,032,854 | A * | 3/2000 | Greer | B65D 27/06 | 229/301 |
| 6,070,792 | A * | 6/2000 | Foushee | B65D 27/06 | 229/302 |
| 7,815,099 | B2 * | 10/2010 | DeLaVergne | B65D 27/34 | 229/301 |
| 2005/0173506 | A1 * | 8/2005 | Bartlett | B65D 27/06 | 229/301 |

FOREIGN PATENT DOCUMENTS

| | | | | |
|---|---|---|---|---|
| GB | 2567217 | A * | 4/2019 | B65D 27/34 |
| WO | 2016120017 | A1 | 8/2016 | |

* cited by examiner

BAG MADE OF PAPER MATERIAL FOR ARCHIVING ARTICLES AND METHOD FOR ARCHIVING AN ARTICLE IN SAID BAG

FIELD OF APPLICATION

The present invention regards a bag made of paper material for archiving articles and a method for archiving an article in said bag, according to the preamble of the respective independent claims.

The present bag is intended to be employed in the field of packaging, for packaging many different articles, which are advantageously intended to be mailed/sent, such as articles purchased via Internet.

More particularly, the bag, object of the present invention, is advantageously employable for archiving an article multiple times, i.e. for archiving it a first time in order to allow mailing/sending the purchased article from the seller to the buyer and for archiving it a second time in order to allow mailing/sending the article-to-be-returned from the buyer once again to the seller.

The invention is therefore inserted in the context of the industrial field of production of packaging and in particular in the production of packaging for the transportation and the mailing/sending of articles.

STATE OF THE ART

As is known, bags have been on the market for years which are made of paper material for archiving articles intended to be transported and/or mailed/sent, for example by means of the postal service or by means of courier.

The bags of known type are provided with two sheet-like elements, including one front and one rear, which are placed facing each other and are joined together at their four perimeter margins, thus defining a containment volume for the articles to be archived.

In addition, the bags of known type are provided with an access opening to the containment volume, such opening delimited by the two free perimeter margins of the two sheet-like elements, i.e. by the free perimeter margin of the front element and by the free perimeter margin of the rear element.

The bags made of paper material of known type are also provided with a closure flap, which is generally made integrally with the sheet-like rear element, projecting from its free margin, and it is susceptible of being folded above the sheet-like front element to cover the access opening of the bag. In addition, such closure flap is generally provided with a strip of adhesive material in order to fix the closure flap itself to the sheet-like front element, in a manner such to ensure the closure of the access opening and prevent the content of the bag from exiting during transport.

Recently, with the development of on-line purchasing and the consequent increase of mailing/sending of goods, even small-size goods, there is consequently an increased need to have bags for archiving articles, and in particular bags that can be used more than once, for example for returning purchased goods. Indeed, the main drawback of on-line purchasing is the fact that the client cannot view the goods before purchase, with the risk that he/she will not be satisfied with the completed purchase. Consequently, most of the websites that allow making on-line purchases also allow the return of the purchased goods, which, once received and viewed by the client, must be once again archived in a bag and mailed/sent again to the sender.

The bags of known type used for mailing/sending articles purchased on-line also comprise information regarding the article itself or details regarding the mailing/sending, which are generally printed on the bag itself and must also be present in the bag containing the returned article, so to be read and deciphered by the courier and/or by the on-line store in order to allow a correct processing of the mailing/sending and classification of the returned article.

In order to facilitate such return operations, the bags of known type used for sending articles purchased on-line are generally reusable bags, i.e. bags which, once mailed/sent by the sender to the client, can be opened in order to allow viewing the article at their interior and can subsequently be reclosed and mailed/sent again by the client to the seller in order to return the article.

More in detail, recloseable bags of known type are generally provided with two strips made of adhesive material, which are arranged along the closure flap parallel to each other. In particular, a first adhesive strip is arranged substantially at the free margin of the closure flap and is intended to be employed in a first closure of the bag and a second adhesive strip is arranged parallel to the first adhesive strip and is intended to be employed in a second closure of the bag itself in order to newly fix the closure flap to the front element of the recloseable bag.

The aforesaid recloseable bags of known type have in practice demonstrated that they do not lack drawbacks.

A first drawback of such bags of known type lies in the fact that the paper material with which they are made is fragile, and hence easy to break during the bag opening operations.

In particular, it frequently happens that the receiver of the bag, during opening, tears the entire closure flap, thus rendering the bag no longer usable since it can no longer be reclosed. Or rather, it was found that the receiver tears the sheet-like front element to which the closure flap is attached, thus destroying the entire bag.

In order to overcome the aforesaid drawback, recloseable bags are known which are made of paper material provided with a weakening line interposed between the two strips made of adhesive material. In particular, the aforesaid weakening line is generally constituted by a plurality of holes aligned with each other, along which the receiver of the bag can act in order to tear only the portion of the closure flap glued to the sheet-like front element of the bag and thus be able to view the contents thereof.

Also such solution has in practice shown that it does not drawbacks. In particular, the weakening line compromises the structural stability of the bag itself which, during the various transport steps, can then be accidentally opened along the aforesaid weakening line.

PRESENTATION OF THE INVENTION

In this situation, the problem underlying the present invention is therefore that of overcoming the drawbacks shown by the bags of known type, by providing a bag made of paper material for archiving articles, which allows a reuse thereof after the first closure.

A further object of the present invention is to provide a bag made of paper material that is structurally strong, which, following a first closing step, can be opened in a first opening step without compromising the integrity, so that it can be reused in a second closing step.

A further object of the present invention is to provide a bag made of paper material that is structurally strong, which ensures the integrity thereof during the entire sending path from the sender to a first receiver and possibly from the latter to a second receiver.

A further object of the present invention is to provide a bag made of paper material which allows executing the operations of closing, opening and reclosing in a quick and easy manner, which does not depend on the ability of the operator who manages the bag.

A further object of the present invention is to provide a bag made of paper material which allows executing the operations of closing, opening and reclosing without losing containment capacity during the reclosing of the bag itself.

A further object of the present invention is to provide a bag that allows executing the operations of closing, opening and reclosing, which is made of biodegradable material.

BRIEF DESCRIPTION OF THE DRAWINGS

The technical characteristics of the invention, according to the aforesaid objects, are clearly seen in the contents of the below-reported claims and the advantages thereof will be more evident in the following detailed description, made with reference to the enclosed drawings, which represent a merely exemplifying and non-limiting embodiment of the invention in which:

DETAILED DESCRIPTION OF A PREFERRED EMBODIMENT

Figure 1:
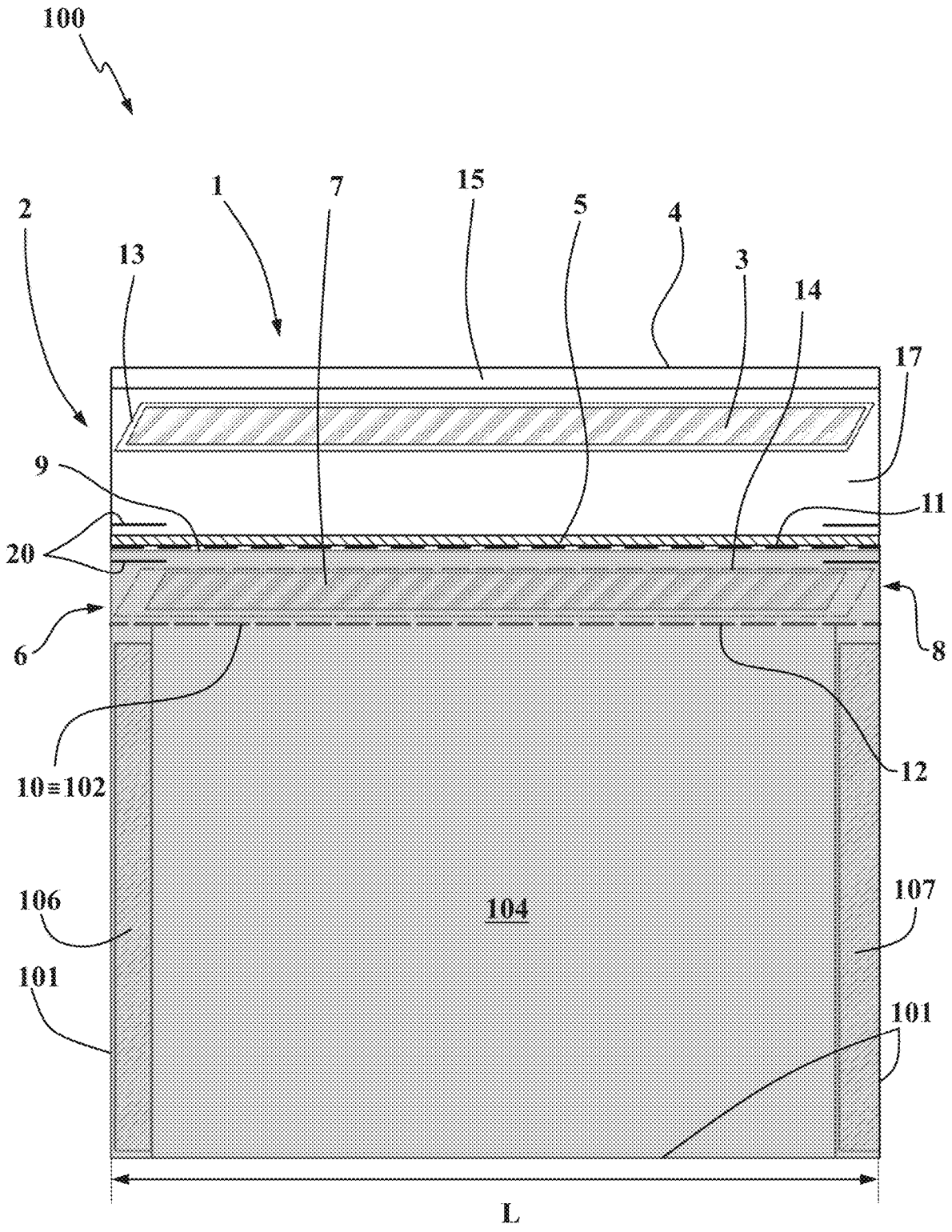
FIG. 1 shows a front view of a bag made of paper material for archiving articles, object of the present invention, in which the closure flap is not folded to close the access opening and in which the sheet-like front element is shown with a darker color than the sheet-like rear element in order to better mark the distinction between the two.

With reference to the enclosed drawings, reference number 100 overall indicates a bag made of paper material, according to the present invention.

In particular, the bag 100 can be made of one or more layers of paper material joined together or by one or more layers of paper material joined to one or more layers of plastic material, for example in order to render impermeable the bag 100 itself.

By "paper material", in this document, it is to be intended a material comprising cellulose on its own or with other components in order to form any one type of paper or cardboard, of any weight and basis weight, which can be folded on itself.

The present bag 100 is intended to be employed for archiving articles of various type and preferably articles to be mailed/sent, e.g. by means of postal service or by means of courier.

The bag 100, object of the present invention, comprises a first rear sheet-like element 103 and a second front sheet-like element 104, superimposed and delimiting between them a containment volume of the bag 100, which is intended to contain articles to be archived.

The first sheet-like element 103 and the second sheet-like element 104 preferably have rectangular shape and are each provided with at least three constrained margins 101 and with at least one access margin 102.

More in detail, each constrained margin 101 of the first sheet-like element 103 is superimposed on and fixed to a corresponding constrained margin 101 of the opposite sheet-like element 104. In addition, the access margin 102 of the first sheet-like element 103 is superimposed on the corresponding access margin 102 of the opposite sheet-like element 104, with the two access margins 102 which delimit between them an access opening to the containment volume of the bag 100.

Advantageously, moreover, the first and the second sheet-like element 103, 104 are provided with two constrained margins 101 substantially parallel to each other and spaced from each other by a distance equal to the length L of the bag 100.

Figure 3:
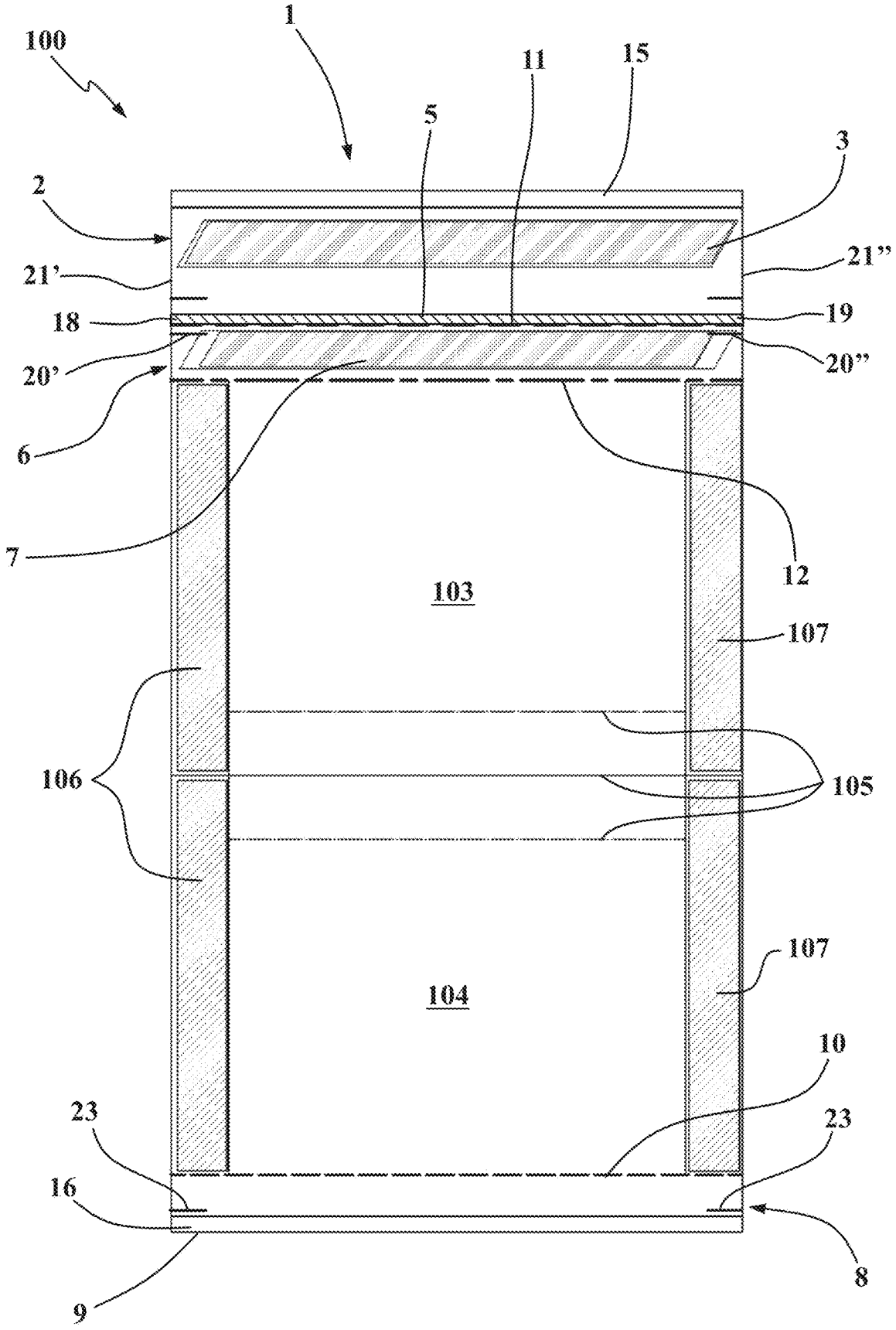
FIG. 3 shows a planar extension of the bag of FIG. 1, in which the internal surface of the bag is visible.
Figure 4:
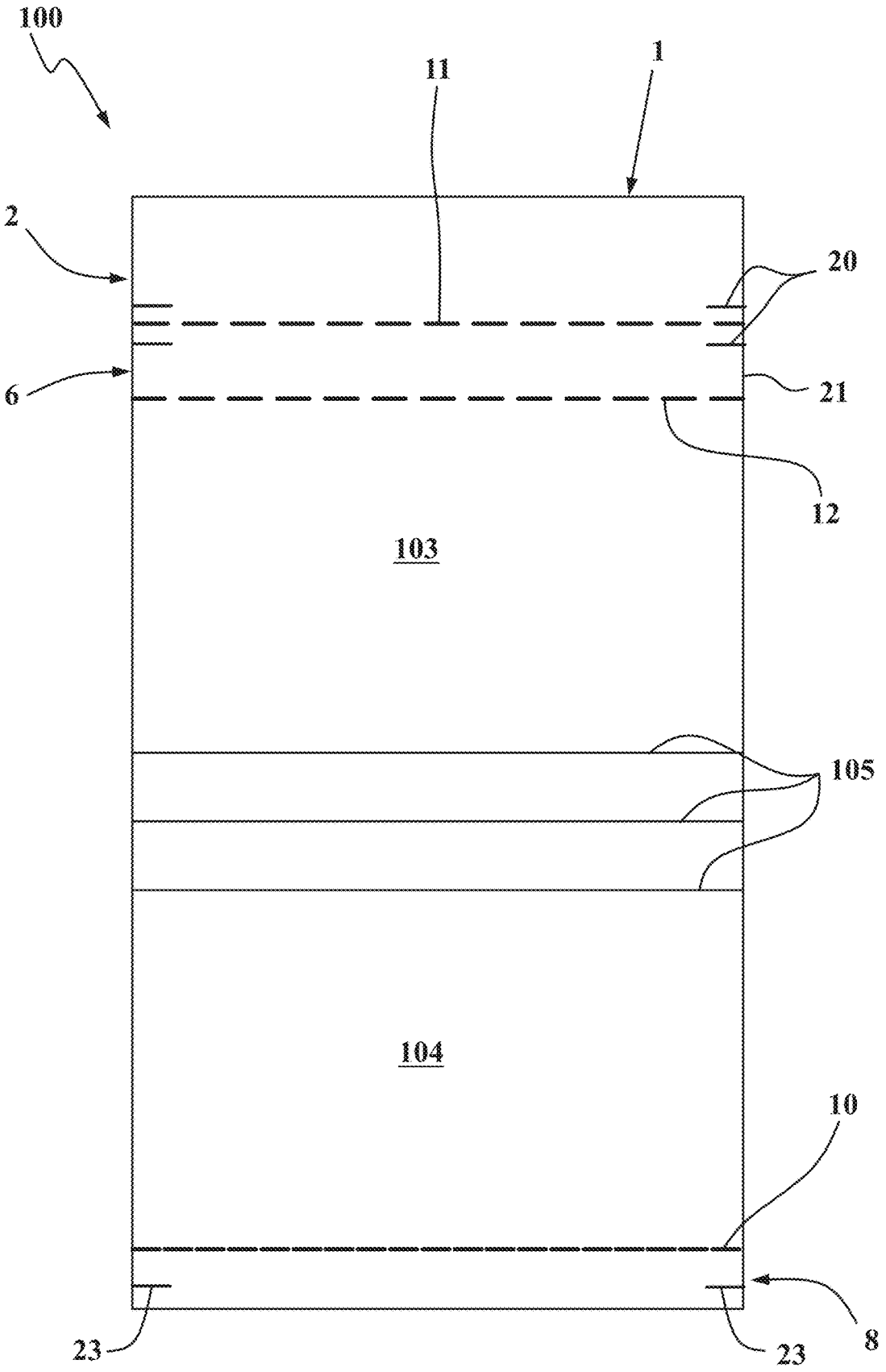
FIG. 4 shows a planar extension of the bag of FIG. 1, in which the external surface of the bag is visible.

In accordance with a preferred embodiment illustrated in FIGS. 3 and 4, the first sheet-like element 103 and the second sheet-like element 104 are integrally made and are joined together by means of one or more folds 105 arranged at a constrained margin 101 of each sheet-like element 103, 104 and in particular arranged at the constrained margin 101 opposite the access margin 102.

In addition, the remaining two constrained margins 101 of each sheet-like element 103, 104 are joined together respectively by means of a third adhesive strip 106 and a fourth adhesive strip 107, preferably arranged along the internal face of each sheet-like element 103, 104, i.e. along the face of the first and second sheet-like element 103, 104 directed towards the opposite sheet-like element 103, 104.

According to the invention, the bag 100 also comprises a closure flap 1, which is projectingly extended from the access margin 102 of the first sheet-like element 103 and is susceptible of being folded at least in partial superimposition on the second sheet-like element 104 in order to close the access opening to the containment volume of the bag 100. In other words, the closure flap 1 is extended beyond the access margin 102 of the opposite second sheet-like element 104, and is susceptible of being folded around the latter up to being at least partially superimposed on the second sheet-like element 104 in order to close the access opening to the containment volume of the bag 100.

In accordance with the preferred embodiment illustrated in the enclosed figures, the closure flap 1 substantially has rectangular shape and is extended longitudinally between its two lateral margins 21 for the entire length L of the bag 100. Preferably, moreover, the two lateral margins 21 of the closure flap 1 are arranged orthogonal to the access margin 102 to the containment volume of the bag 100. Preferably, moreover, the closure flap 1 is made integrally the first sheet-like element 103 from which it is extended.

According to the invention, the closure flap 1 of the bag 100 is provided with a first portion 2, for a first closure of the bag 100, and with a second portion 6 for a second closure of the bag 100 itself. In addition, the first portion 2 of the flap 1 is provided with a first adhesive strip 3 and the second portion 6 is provided with a second adhesive strip 7, in order to fix the first portion 2 and the second portion 6 to the second sheet-like element 104 respectively in the first and in the second closure of the bag 100.

Preferably, the first and second adhesive strip 3, 7 are extended preferably for the entire length L of the bag 100. Advantageously, moreover, the first and the second adhesive strip 3, 7 are made by depositing a continuous strip of adhesive material (e.g. glue) along the closure flap 1 of the bag 100, and such continuous strip of adhesive material can for example have rectangular shape. Otherwise, in accordance with a different embodiment not illustrated in the enclosed figures, the first and the second adhesive strip 3, 7 can be made by depositing a discontinuous strip of adhesive material along the closure flap 1 of the bag 100, for example by depositing a series of aligned glue drops respectively along the first and the second adhesive strip 3, 7.

According to the idea underlying the present invention, the closure flap 1 comprises a tear tape 5 arranged between the first portion 2 and the second portion 6, with the first portion 2 which is extended between a first free end 4 of the closure flap 1 and the tear tape 5, and the second portion 6 which is extended between the tear tape 5 and the access margin 102 of the first sheet-like element 103, from which the closure flap 1 is extended. In addition, the tear tape 5 is susceptible of being torn from the closure flap 1 in order to separate the first portion 2 of the closure flap 1 from the second portion 6.

More in detail, the tear tape 5 is advantageously fixed, e.g. by means of glue, to the closure flap 1 and preferably is extended longitudinally for the entire length L of the closure flap 1. Advantageously, in this manner, by tearing the tear tape 5 from the closure flap 1, consequently also the closure flap 1—with which the tear tape is fixed—is torn and the first portion 2 is separated from the second portion 6.

Preferably, moreover, the tear tape 5 is made of plastic material, such as nylon, and is provided with a sufficient thickness such that it is hard to manually break by a user who actuates it in order to separate the first portion 2 of the closure flap 1 from the second portion 6. Advantageously, in this manner, a user who acts on the tear tape 5 is capable of tearing the first portion 2 of the closure flap 1 for the entire extension of the tear tape 5.

The tear tape 5 is longitudinally extended between a first end 18, advantageously arranged at a first lateral margin 21' of the closure flap 1, and a second end 19, advantageously arranged at a second lateral margin 21" of the closure flap 1 opposite the first lateral margin 21'. Preferably, moreover, the tear tape 5 is arranged parallel to the first free end 4 of the first portion 2 of the closure flap 1 itself and still more preferably is also parallel to the first and to the second adhesive strip 3, 7.

According to the idea underlying the present invention, moreover, the bag 100 made of paper material is provided with a removable flap 8 projectingly extended from the access margin 102 of the second sheet-like element 104 between a second free end 9 and a weakening line 10, which is obtained at the aforesaid access margin 102 of the second sheet-like element 104, and is susceptible of being torn in order to remove the removable flap 8 from the second sheet-like element 104.

Preferably, the removable flap 8 is made integrally with the second sheet-like element 104 and constitutes a continuation thereof.

Advantageously, the weakening line 10 is made by means of a per se known process, for example it can be made by means of a series of holes arranged aligned and close to each other along the weakening line 10 itself, thus creating a specific zone in which it is easier to tear the removable flap 8.

In accordance with the preferred embodiment illustrated in the enclosed figures, the first portion 2 of the closure flap 1 is provided with a first folding line 11, along which the first portion 2 is susceptible of being folded for the first closure of the bag 100 and preferably also the second portion 6 of the closure flap 1 is provided with a second folding line 12, along which the second portion 6 is susceptible of being folded for the second closure of the bag 100.

In accordance with the preferred embodiment illustrated in FIG. 1, the first folding line 11 is placed at the tear tape 5. Otherwise, in accordance with a second embodiment, not illustrated in the enclosed figures, the first folding line 11 is placed in proximity to the tear tape 5, with the tear tape 5 interposed between the first folding line 11 and the first free end 4 of the closure flap 1.

Figure 2:
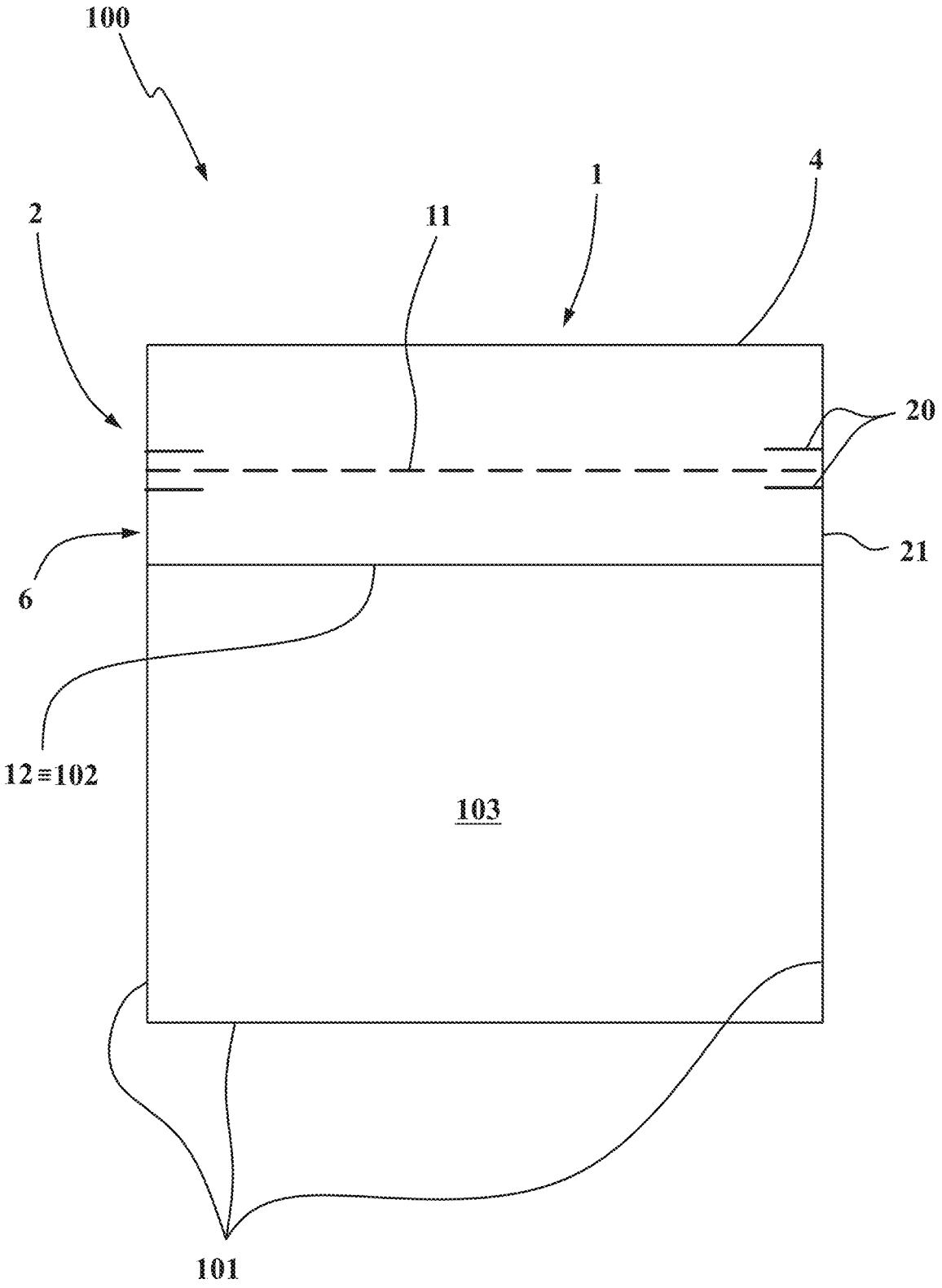
FIG. 2 shows a rear view of the bag of FIG. 1.

In addition, in accordance with the embodiment indicated in FIG. 2, the second folding line 12 is preferably placed at the access margin 102 of the first sheet-like element 103 and preferably coincides with the latter.

The first and/or the second folding line 11, 12 can advantageously be made by means of processes of known type and therefore not described in detail hereinbelow, for example by means of creasing the paper material, or by means of making a recess along the entire folding line, along which the paper material is susceptible of being folded by approaching the two walls of the recess.

Preferably, moreover, the first free end 4 of the first portion 2, the first and the second adhesive strip 3, 7, the tear tape 5, the first and the second folding line 11, 12 are all parallel to each other and are extended for the entire length L of the bag 100.

Naturally, the closure flap 1 can also assume shapes that are different from rectangular, without departing from the scope of this patent. For example, it can assume trapezoidal shape in which its external angles, interposed between the first free end 4 and its lateral margins 21, are flared. Otherwise, in addition the closure flap 1 can have rounded external angles. In this case, the adhesive strips 3, 7, the tear tape 5 and the folding lines 11, 12 might not be parallel to each other and they can be extended for lengths different from the length L of the bag 100.

In accordance with the preferred embodiment illustrated in the enclosed figures, the removable flap 8 has substantially rectangular shape and is extended for the entire length L of the bag 100. Preferably, moreover, also the second free end 9 of the removable flap 8 and the weakening line 10 are parallel to each other and are extended for the entire length L of the bag 100.

Naturally, also the removable flap 8 can assume shapes different from the rectangular. In this case, the second free end 9 and the weakening line 10 might not be parallel to each other.

Advantageously, the closure flap 1 is also provided with at least two incision lines 20 which are extended along the closure flap 1 itself with the tear tape 5 interposed between them, and are susceptible of being torn in order to tear the tear tape 5 from the closure flap 1.

More in detail, the two incision lines 20 with the tear tape 5 interposed are extended one along the first portion 2 of the closure flap 1 and the other along the second portion 6 of the closure flap 1 itself. In addition, each of the two incision lines 20 are advantageously extended starting from the lateral margin 21 of the closure flap 1 for a length smaller than the length L of the closure flap 1 and preferably it is extended for a length comprised between 1 millimeter and 1 centimeter.

Advantageously, in addition, the two incision lines 20 are substantially symmetric with respect to the first fold line 11, and preferably also with respect to the tear tape 5 coinciding with such first fold line 11. In this manner, with the first portion 2 of the closure flap 1 folded along the first fold line 11, the two incision lines 20 are substantially superimposed on each other.

Advantageously, in addition, the two incision lines 20 are arranged substantially parallel to the tear tape 5 interposed therebetween; it is nevertheless also possible that such incision lines 20 are arranged tilted with respect to the tear tape 5.

Advantageously, also the removable flap 8 is provided with a third incision line 23 which is extended along the removable flap 8 itself along a path substantially coinciding with the path of one of the two incision lines 20 made along the closure flap 1, in a manner such that, with the first portion 2 of the closure flap 1 folded along the first fold line 11, the two incision lines 20 and the third incision line 23 are substantially superimposed on each other.

Preferably, the two incision lines 20 are extended starting from the first margin 21' of the closure flap 1 and are susceptible of being torn in order to free the first end 18 of the tear tape 5 so as to allow a user to grip such first end 18 of the tear tape 5 in order to tear the first portion 2 of the closure flap 1. Still more preferably, the closure flap 1 is provided with four incision lines 20, of which two first incision lines 20' are arranged at at the first end 18 of the tear tape 5, as described above, and two second incision lines 20" are arranged at the second end 19 of the tear tape 5 itself, mirrored with respect to the first two incision lines 20'. In this manner, a user can select which end of the tear tape 5 to free in order to open the bag 100. For example, a left-handed user could select to free the second end 19.

Advantageously, also the removable flap 8 is provided with two third incision lines 23, extended starting from the two lateral margins of the removable flap 8 in a manner such that, with the first portion 2 of the closure flap 1 folded along the first fold line 11, one of the two third incision lines 23 is substantially coinciding with the first two incision lines 20' and the other third incision line 23 is substantially coinciding with the second two incision lines 20".

In accordance with a further embodiment not illustrated in the enclosed figures, the closure flap 1 is provided with a single incision line, e.g. shaped with V or U form, which is provided with two sections which are symmetrically extended with respect to each other with the tear tape 5 interposed, as described above in relation to the two incision lines 20. For example, such incision line can be extended along a V or U shaped path at least partially surrounding the first end 18 or the second end 19 of the tear flap 5 so as to allow a user to free such end of the tear tape 5 in order to open the bag 100. Of course, it is also possible that the closure flap 1 be provided with two of the aforesaid incision V or U shaped lines, of which one is arranged to at least partially surround the first end 18 of the tear tape and the other one is arranged to at least partially surround the second end 19.

In the enclosed FIG. 1, a preferred embodiment of the bag 100 made of paper material is indicated, object of the present invention, in which the second sheet-like element 104 was shown with a darker color than the first sheet-like element 103 in order to better view the extension and the borders. In addition, in the view of FIG. 1, the second sheet-like element 104 is placed in front of the first sheet-like element 103, with the first sheet-like element 103 that projects beyond the second sheet-like element 104 only with the first portion 2 of the closure flap 1.

Preferably, in fact, the second free end 9 of the removable flap 8 is substantially superimposed on the tear tape 5 of the closure flap 1. In addition, the weakening line 10 of the removable flap 8 is preferably superimposed on the second folding line 12 of the closure flap 1. In other words, the free edge 102 of the second sheet-like element 104 is substantially superimposed on the free edge 102 of the first sheet-like element 103.

In this manner, the removable flap 8 is substantially superimposed on the second portion 6 of the closure flap 1, and protects the latter, for example during the first step of opening the bag 100.

According to the preferred embodiment illustrated in FIG. 1, the bag 100 made of paper material also comprises a first protective strip 13 and a second protective strip 14 preferably made of silicone paper, which are respectively placed to protect the first adhesive strip 3 and the second adhesive strip 7. In operation, the first and the second protective strip 13, 14 are susceptible of being removed respectively from the first and from the second adhesive strip 3, 7 before the first and second closure of the bag 100, so as to provide a strip of adhesive material that is ready to be fixed.

Preferably, the first portion 2 of the closure flap 1 is provided with a first reinforcement turn-up 15 extended along the first free end 4, and preferably along the entire first free end 4, and such first turn-up 15 is adapted to reinforce the first free end 4 itself, for example in order to prevent it from being accidentally torn.

Advantageously, the first reinforcement turn-up 15 is made by means of folding the first portion 2 of the closure flap 1 or by means of at least partial superimposition of a paper strip on the first portion 2 of the closure flap 1 itself.

Preferably, moreover, the removable flap 8 is provided with a second reinforcement turn-up 16 extended along its second free end 9, and preferably along the entire second free end 9, and such second turn-up 16 is adapted to reinforce the second free end 9 itself, for example in order to prevent it from being accidentally torn.

Advantageously, also the second reinforcement turn-up 16 is made by means of folding the removable flap 8 or by means of at least partial superimposition of a paper strip on the removable flap 8 itself.

The first turn-up 15 and the second reinforcement 16 advantageously allow an easy grip respectively of the first portion 2 and of the removable flap 8, facilitating the opening of the bag 100 and the operation of tearing the removable flap 8.

In accordance with the embodiment indicated in the enclosed figures, the first portion 2 of the closure flap 1 is also provided with a covering sector 17, which is advantageously longitudinally extended for the entire length L of the bag 100 and is extended transversely between the tear tape 5 and the first adhesive strip 3.

Advantageously, such covering sector 17 has transverse extension at least equal to the transverse extension of the removable flap 8, between the second free end 9 and the weakening line 10, and is susceptible of being placed to cover the removable flap 8 with the first portion 2 of the closure flap 1 in the first closure of the bag 100. In other words, during the first closure of the bag 100, the covering sector 17 is placed to cover the removable flap 8 and the first adhesive strip 3 is susceptible of being fixed to the second front element 104, in a position comprised between its access margin 102 and its constrained margin 101 opposite the access margin 102.

In accordance with an alternative embodiment, not illustrated in the enclosed figures, the first portion 2 of the closure flap 1 is not provided with the covering sector 17. In the latter embodiment, during the first closure of the bag 100, the first adhesive strip 3 is susceptible of being fixed to the second front element 104, in a position comprised between the access margin 102 and the second free end 9 of the removable flap 8. In other words, the first portion 2 of the closure flap 1 is susceptible of being fixed at the removable flap 8.

Also forming the object of the present invention is a method for archiving an article in a bag of the above-described type and regarding which the same reference nomenclature will be employed hereinbelow for the sake of description simplicity.

Preferably, the archiving method, object of the present invention, provides for a first step of insertion of an article within the containment volume of the bag 100.

Figure 5:
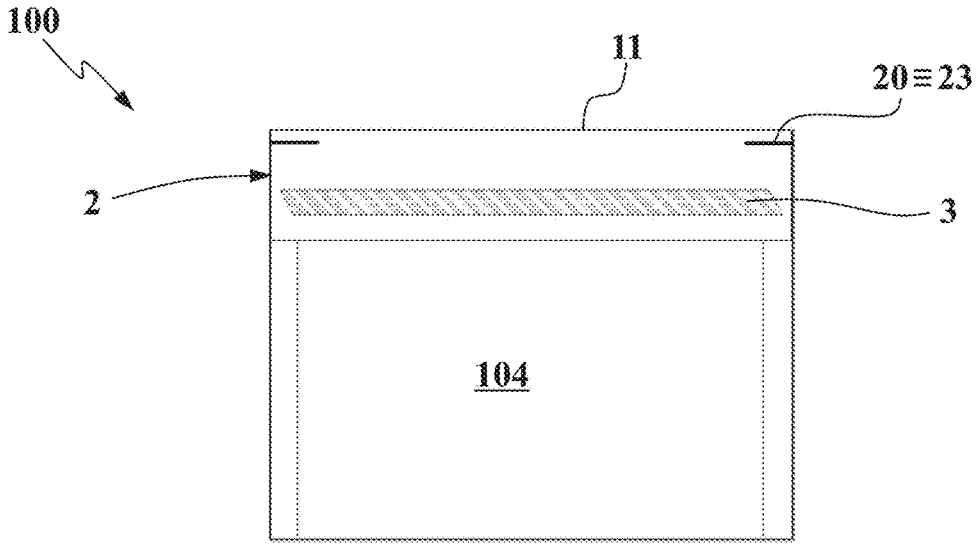
FIG. 5 shows a front view of the bag of FIG. 1 following a first step of closing the bag itself.

According to the invention, the archiving method comprises a first step of closing the bag 100 in which the first portion 2 of the closure flap 1 is folded at least in partial superimposition of the second sheet-like element 104 in order to close the access opening to the containment volume, as indicated in FIG. 5.

Advantageously, the first portion 2 is folded along the first folding line 11, which preferably coincides with the tear tape 5. Consequently, the first portion 2 is preferably folded along the tear tape 5.

According to the invention, the archiving method then comprises a first step of sealing the bag 100 in which the first adhesive strip 3 adheres to the second sheet-like element 104 in order to fix the first portion 2 of the closure flap 1 to the second sheet-like element 104. Before such first sealing step, the first adhesive strip 3 is advantageously made available by removing the first protective strip 13, placed to cover the first adhesive strip 3 itself. In this manner, the article to be archived is safely contained within the containment volume of the bag 100 and is advantageously ready to be mailed/sent.

Advantageously, in accordance with the embodiment of the bag 100 illustrated in the enclosed images, in which the first portion 2 of the closure flap 1 is provided with the covering sector 17, the first portion 2 itself is fixed to the second sheet-like element 104 in an intermediate position between the access margin 102 of the second sheet-like element 104 and its constrained margin 101 opposite the access margin 102.

The archiving method, object of the present invention, then provides for a first step of opening the bag 100, for example by the receiver of the bag 100 itself, so as to view the article at its interior. In such first opening step, the first portion 2 of the closure flap 1 is torn by means of the tear tape 5 in order to open the access opening to the containment volume of the bag 100 itself.

Preferably, such opening step provides for freeing the first end 18 of the tear tape 5 by tearing the first incision lines 20'. Consequently, a user who wishes to open the bag grips the first end 18 and pulls it towards the second end 19 of the tear tape 5.

In this manner, the tear tape 5 is torn from the closure flap 1 and separates the first portion 2 of the closure flap 1 itself from the second portion 6, thus opening the access opening to the containment volume of the bag 100. In addition, in such first opening step, the first portion 2 is susceptible of being freed from the second sheet-like element 104, i.e. the first adhesive strip 3 is susceptible of being removed from the second sheet-like element 104 to which it was fixed in the first sealing step, this freeing the first portion 2.

Advantageously, in the first step of opening the bag 100, the tear tape 5 is susceptible of acting as a guide for tearing the first portion 2 of the closure flap 1, and thus allows reducing the risk that the receiver who opens the bag 100 may also tear other parts of the bag 100 itself, rendering it no longer usable.

After the first step of opening the bag 100, the receiver can then extract the article archived within the containment volume of the bag itself and view it. If the article archived in the bag 100 is not appreciated by the receiver, or if the latter wishes to newly use the bag 100 in order to mail/send the same article or another, it will be sufficient to insert the article within the containment volume of the bag 100 itself and close it as described hereinbelow.

Figure 7:
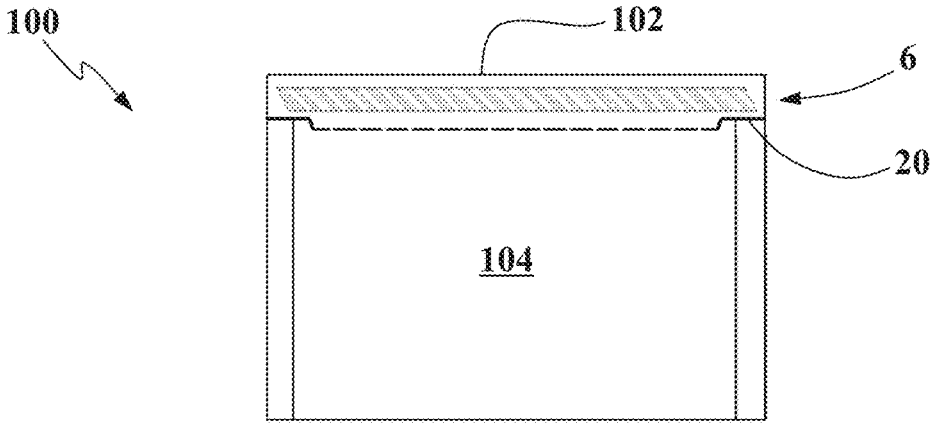
FIG. 7 shows a front view of the bag of FIG. 1 following a second step of closing the bag itself.

The archiving method, object of the present invention, then provides for a second step of closing the bag 100 in which the second portion 6 of the closure flap 1 is folded, preferably along the second folding line 12, at least in partial superimposition of the second sheet-like element 104 in order to newly close the access opening to the containment volume of the bag 100 itself, as indicated in the enclosed FIG. 7.

According to the idea underlying the present invention, the present archiving method also comprises a step of removing the removable flap 8 in which the removable flap 8 is torn along the weakening line 10, preferably before the second step of closing the bag 100.

Advantageously, in fact, as described above, the removable flap 8 is substantially superimposed on the second portion 6 of the closure flap 1, so as to protect such second portion 6 during the first step of opening the bag 100 and, more in detail, so as to protect the second adhesive strip 7 of the second portion 6. In this manner, after the first step of opening the bag 100, the second portion 6 of the closure flap 1 does not project beyond the second sheet-like element 104 of the bag 100, and hence it cannot be folded again to close the access opening to the containment volume of the bag 100 itself. Consequently, the removable flap 8 is removed before the second step of closing the bag 100, such that the second portion 6 projects beyond the second sheet-like element 104 and then can be folded, being superimposed on the latter in order to close the access opening to the containment volume of the bag 100.

In accordance with the alternative embodiment, described above, in which the first portion 2 of the closure flap 1 is not provided with the covering sector 17, the second portion 6 is fixed to the second sheet-like element 104 in an intermediate position between the access margin 102 of the second sheet-like element 104 itself and the second free end 9 of the removable flap 8. In other words, the second portion 6 is fixed at the removable flap 8.

In such alternative embodiment, the first step of opening the bag 100 substantially coincides with the step of removing the removable flap 8 itself. Indeed, during the first opening step, the receiver who acts on the tear tape 5 in order to free the first portion 2 from the second sheet-like element 104, simultaneously also acts on the weakening line 10 of the removable flap 8, which is torn together with the first portion 2 which is fixed thereon.

Figure 6:
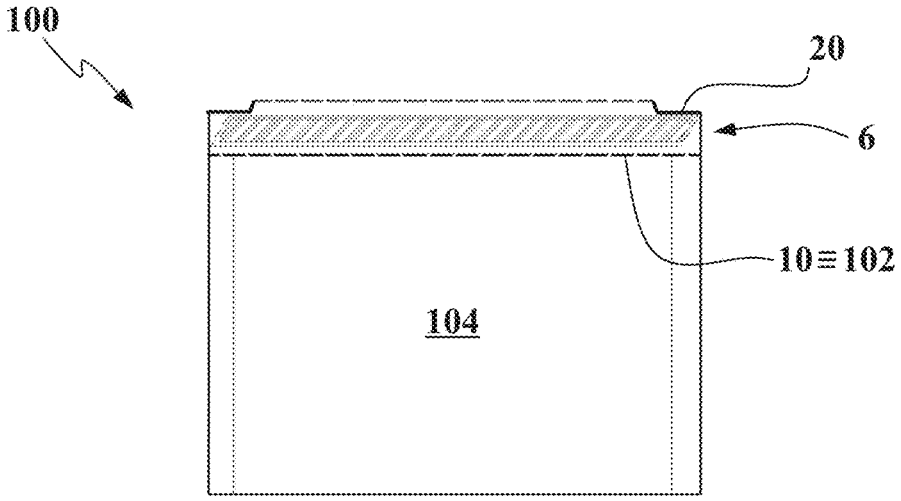
FIG. 6 shows a front view of the bag of FIG. 1 following a step of removing a removable flap of the bag itself.

Such alternative embodiment can nevertheless have the disadvantage that, in the first opening step, the receiver is unable to completely remove the removable flap 8, since the first adhesive strip 3 which fixes the first portion 2 of the closure flap 1 to the removable flap 8 can be torn or not remain perfectly fixed to the removable flap 8. In the latter case, the removing step only partially coincides with the first step of opening the bag 100 and it may be necessary to act a second time on the weakening line 10 so as to completely remove the removable flap 8. Consequently, in the opening step, by removing the first portion 2 of the closure flap 1, also the removable flap 8 is removed and the bag 100 remains with the second portion 6 of the closure flap 1 projecting beyond the access margin 102 of the second sheet-like element 104, ready to be folded along the second fold line 12 in the second closing step, as indicated in the enclosed FIG. 6.

Advantageously, therefore, in such alternative embodiment of the bag 100, during the first closing step and in the first sealing step, the first portion 2 of the closure flap 1 is superimposed on and fixed to the removable flap 8 and during the second closing step the second portion 6 of the closure flap 1 is superimposed on the second sheet-like element 104.

Preferably, the archiving method, object of the present invention, then provides for a second step of sealing the bag 100 in which the second adhesive strip 7 of the second portion 6 of the closure flap 1 adheres to the second sheet-like element 104 in order to fix the second portion 6 to the second sheet-like element 104 itself. Before such second sealing step, the second adhesive strip 7 is advantageously provided by removing the second protective strip 14, placed to cover the second adhesive strip 7 itself.

Advantageously, in such second sealing step, the second portion 6 is fixed to the second sheet-like element 104 in an intermediate position between the access margin 102 of the second sheet-like element 104 and its constrained margin 101 opposite the access margin 102.

The present archiving method then advantageously provides for a second step of opening the bag 100, in which a second receiver acts on the second folding line 12 by tearing it and newly opening the access opening to the containment volume of the bag 100.

Following this second opening step, the bag 100 might no longer be usable for archiving articles, since the closure flap 1 has been completely removed. Otherwise, the closure flap 1 can comprise other portions, separated from each other by other tear tapes, by means of which the remaining portions of the closure flap 1 can be torn in other subsequently steps of opening the bag 100.

The bag 100 made of paper material and archiving method thus conceived therefore attain the pre-established objects.

In particular, the bag 100 and the archiving method, object of the present invention, provide for closing, in the first closure step, the first portion 2 of the closure flap 1 by folding it along the tear tape 5, which constitutes a reinforcement of the bag 100 itself. In this manner, the bag 100 is structurally strong and therefore the risk of accidental openings of the bag 100 itself is considerably reduced.

The invention claimed is:

1. A bag made of paper material for archiving articles, the bag comprising:

a first sheet-like element and a second sheet-like element, superimposed and delimiting between them a containment volume of said bag intended to contain articles to be archived; each of said first and second sheet-like elements being provided with:

at least three constrained margins, superimposed and fixed to the corresponding three constrained margins of the opposite sheet-like element, at least one access margin superimposed on the corresponding access margin of the opposite sheet-like element, and said access margins delimit between them an access opening to said containment volume;

a closure flap, projectingly extended from the access margin of said first sheet-like element, wherein said closure flap is susceptible of being folded at least in partial superimposition on said second sheet-like element in order to close said access opening to said containment volume; said closure flap being provided with a first portion, comprising a first adhesive strip for a first closure of said bag, and a second portion, comprising a second adhesive strip for a second closure of said bag;

wherein:

said closure flap comprises a tear tape, which is arranged between said first portion and said second portion, and is susceptible of being torn from said closure flap in order to separate said first portion from said second portion;

said first portion is extended between a first free end of said closure flap and said tear tape;

said second portion is extended between said tear tape and the access margin of said first sheet-like element;

said bag is provided with a removable flap projectingly extended from the access margin of said second sheet-like element between a second free end and a second weakening line, which is obtained at said access margin and is susceptible of being torn in order to remove said removable flap from said second sheet-like element;

wherein the first portion of said closure flap is provided with a first reinforcement turn-up, extended along said first free end to reinforce said first free end.

2. The bag of claim 1, wherein said closure flap is provided with two incision lines, which are extended along said closure flap with said tear tape interposed between them, and they are susceptible of being torn in order to tear said tear tape from said closure flap.

3. The bag of claim 1, wherein:

the first portion of said closure flap is provided a first folding line, along which said first portion is susceptible of being folded for the first closure of said bag;

the second portion of said closure flap is provided with a second folding line, along which said second portion is susceptible of being folded for the second closure of said bag.

4. The bag of claim 1, wherein said removable flap is provided with a second reinforcement turn-up, extended along said second free end to reinforce said second free end.

5. The bag of claim 1, wherein the first portion of said closure flap is provided with a covering sector transversely extended between said tear tape and said first adhesive strip, and such covering sector has transverse extension at least equal to the extension of said removable flap between said second free end and said weakening line, and is susceptible of being placed to cover said removable flap with the first portion of said closure flap in said first closure.

6. The bag of claim 1, wherein the second free end of said removable flap is substantially superimposed on the tear tape of the first portion of said closure flap, and said removable flap is superimposed on the second portion of said closure flap.

7. The bag of claim 1, further comprising a first protective strip and a second protective strip respectively placed to protect said first adhesive strip and said second adhesive strip.

8. The bag of claim 1, wherein said tear tape is made of plastic material.

9. The bag of claim 8, wherein said tear tape is made of nylon.

10. A bag made of paper material for archiving articles, the bag comprising:

a first sheet-like element and a second sheet-like element, superimposed and delimiting between them a containment volume of said bag intended to contain articles to be archived; each of said first and second sheet-like elements being provided with:

at least three constrained margins, superimposed and fixed to the corresponding three constrained margins of the opposite sheet-like element, at least one access margin superimposed on the corresponding access margin of the opposite sheet-like element, and said access margins delimit between them an access opening to said containment volume;

a closure flap, projectingly extended from the access margin of said first sheet-like element, wherein said closure flap is susceptible of being folded at least in partial superimposition on said second sheet-like element in order to close said access opening to said containment volume; said closure flap being provided with a first portion, comprising a first adhesive strip for a first closure of said bag, and a second portion, comprising a second adhesive strip for a second closure of said bag;

wherein:

said closure flap comprises a tear tape, which is arranged between said first portion and said second portion, and is susceptible of being torn from said closure flap in order to separate said first portion from said second portion;

said first portion is extended between a first free end of said closure flap and said tear tape;

said second portion is extended between said tear tape and the access margin of said first sheet-like element;

said bag is provided with a removable flap projectingly extended from the access margin of said second sheet-like element between a second free end and a second weakening line, which is obtained at said access margin and is susceptible of being torn in order to remove said removable flap from said second sheet-like element;

wherein said removable flap is provided with a reinforcing turn-up, extended along said second free end to reinforce said second free end.

* * * * *